US005388305A

United States Patent [19]

Fields

[11] Patent Number: 5,388,305

[45] Date of Patent: Feb. 14, 1995

[54] VACUUM BUFFER

[75] Inventor: William A. Fields, Livermore, Calif.

[73] Assignee: Surtec, Inc., Hayward, Calif.

[21] Appl. No.: 123,409

[22] Filed: Sep. 17, 1993

[51] Int. Cl.[6] ..... A47L 5/10

[52] U.S. Cl. ..... 15/385; 15/420

[58] Field of Search ..... 15/385, 420

[56] References Cited

U.S. PATENT DOCUMENTS

| | | | |
|---|---|---|---|
| 2,801,437 | 8/1957 | Okun | 15/385 |
| 3,314,099 | 4/1967 | Otto | 15/385 |
| 3,678,534 | 7/1972 | Hilbig | 15/420 |
| 3,719,966 | 3/1973 | Lamont | 15/385 |
| 4,598,440 | 7/1986 | Wilson | 15/385 |
| 4,731,895 | 3/1988 | Zack | 15/385 |
| 4,939,811 | 7/1990 | Matunaga | 15/385 |
| 5,163,203 | 11/1992 | Tanasescu | 15/385 |

*Primary Examiner*—David A. Scherbel
*Assistant Examiner*—Terrence R. Till
*Attorney, Agent, or Firm*—Townsend and Townsend; Khourie and Crew

[57] ABSTRACT

A high speed propane power buffer is provided with a dust evacuation system. A peripheral skirt is telescopically depended from a hood overlying the high speed rotating buffer pad. This skirt, at the extremity adjacent the surface to be polished, is supplied with angularly inclined grooves sloped away from the radial disposition with respect to the buffer. These angularly inclined grooves slope from the outside of the skirt to the inside of the skirt in the direction of buffer disc rotation at the disc periphery and are maintained by the telescoping skirt immediately adjacent the surface being polished. Entrained air is drawn at the surface being polished in the direction of buffer disc rotation from the outside of the skirt to the inside of the skirt through the slanting louvers establishing a buffer dust confining boundary at the depending peripheral skirt immediately adjacent the floor. Overlying the rotating buffer disc, the protective hood defines a concavity between the top of the buffer and the underside of the protective hood. This concavity can expand in the direction of buffer rotation from a narrow buffer to hood dimension circumferentially beyond a hood dust collection aperture to a large buffer to hood dimension at the dust collection aperture. When buffer rotation occurs, air is entrained by the upper surface of the rotating buffer disk. This accumulates air and stalls at the large hood volume overlying the top surface of the buffer immediate the dust collection aperture of the protective hood.

9 Claims, 4 Drawing Sheets

VACUUM BUFFER

This invention relates to high speed buffers utilized for large polished floor surfaces, such as those found in super markets. In particular and for preferred installation on a propane powered high speed floor buffers, a dust containment system utilizing vacuum is disclosed.

BACKGROUND OF THE INVENTION

Large polished floor surfaces are the standard for the modern retail environment. For both appearance and cleanliness, these surfaces are waxed and buffed. In the modern store environment, relatively large (from one-half to three feet in diameter), high speed buffers are utilized.

The standard construction of these buffers is relatively easy to describe. They usually include a wheel mounted chassis carrying a motor for driving the buffer. These buffers depend from the chassis for polishing the floor. A protective hood is mounted to the chassis and depends over the high speed rotating buffer during polishing floor contact. This protective hood serves to prevent contact with the rotating buffer pad from either above or from the side. When the floors are first swept and/or mopped, and thereafter waxed and buffed by such buffer, a clean and inviting appearance is imparted to the store.

Unfortunately, such buffing is far from a dust free environment. The large buffing pads, rotating in the order of 2,000 revolutions per minute, accumulate dust on their respective buffing surface. This dust is liberated during the dusting process by passing under the protective cover at the sides of the rotating buffer pad. Such dust liberation is especially aggravated when the buffing pad during polishing comes against any irregularity in the surface being polished—such as a seam in the flooring.

Further, the dust that is liberated is particularly obnoxious. Typically, it is of extremely small particle size—slightly larger than one micron—and is centrifugally thrown outward of the buffer during the high speed buffing operation.

Left uncontrolled, this dust liberation represents a serious problem. Dust from buffing is thrown outwardly at high speed, billows upwardly from the buffing site, and settles everywhere, including high surfaces that are relatively removed from the floor surface being polished. Further, and while the dust is airborne, it is at least even with the nose and mouth of workers operating the buffer apparatus. Consequently, it constitutes a health hazard due to the possibility of inhalation.

SUMMARY OF THE PRIOR ART

Attempts of the prior art to solve this problem have included depending skirts to confine dust flow to within the protective hood suspended over and around the rotating buffer. Further, such depending skirts have been combined with radial apertures or louvers in the skirt. Many buffers combine the buffer with either a vacuum dust evacuator. Such evacuators either rely on air entrained by the rotating buffer or have independently powered vacuum apparatus to capture the dust by venting air from under the protective hood to bags.

Legatt U.S. Pat. No. 5,088,151 discloses a dust containment system utilizing a depending skirt in combination with a so-called "air dam" adjacent the top of the rotating buffer for buffer entrained air pumping to a dust collecting bag.

McLeod et. al. U.S. Pat. No. 4,720,886; Todd et. al. U.S. Pat. No. 4,715,087; Bonfanti U.S. Pat. No. 3,022,529; Otto U.S. Pat. No. 3,314,099; and Mitchell U.S. Pat. No. 4,178,654 all include the combination of a depending skirt and an independently driven vacuum dust evacuator communicated to the protective hood.

Maatunaga et al. U.S. Pat. No. 4,939,811; and Wilson U.S. Pat. No. 4,598,440 illustrate the principle of having the rotation of the rotating buffer cause the desired evacuation of dust from under the protective hood and skirt.

Finally, Lamont U.S. Pat. No. 3,531,819 includes a skirt with louvers which is claimed to produce a vacuum to a collecting dust bag. These louvers constitute windows radial to the peripheral surface of the rotating buffer.

DISCOVERY

I have found that radially extending louvers in the skirt at essentially right angles to the rotating periphery of the buffer can act to broadcast dust. Further, many straight vacuum systems which merely communicate to the hood are not able to draw sufficient vacuum; the rotating air entrained by the high speed rotating buffer simply bypasses the vacuum inlet. Attempts to allow the rotating buffer to supply the total pumping action are insufficient; dust is still broadcast at the periphery of the buffing pad—out from under and underneath the housing or protective skirt.

SUMMARY OF THE INVENTION

A high speed propane power buffer is provided with a dust evacuation system. A peripheral skirt is telescopically depended from a hood overlying the high speed rotating buffer pad. This skirt, at the extremity adjacent the surface to be polished, is supplied with angularly inclined grooves sloped away from the radial disposition with respect to the buffer. These angularly inclined grooves slope from the outside of the skirt to the inside of the skirt in the direction of buffer disc rotation at the disc periphery and are maintained by the telescoping skirt immediately adjacent the surface being polished. Entrained air is drawn at the surface being polished in the direct of buffer disc rotation from the outside of the skirt to the inside of the skirt through the slanting louvers establishing a buffer dust confining boundary at the depending peripheral skirt immediately adjacent the floor.

Overlying the rotating buffer disc, the protective hood defines a concavity between the top of the buffer and the underside of the protective hood. This concavity expands in the direction of buffer rotation from a narrow buffer to hood dimension circumferentially beyond a hood dust collection aperture to a large buffer to hood dimension at the dust collection aperture. When buffer rotation occurs, air is entrained by the upper surface of the rotating buffer to accumulate and stall at the large hood volume overlying the top surface of the buffer immediately below the dust collection aperture of the protective hood.

A deflector is utilized to scoop air upwardly from this large volume under positive pressure to the dust collector aperture. A dust collector vacuum communicates with the dust collection aperture and includes its own vacuum pump drawing suction through the dust collection aperture. This apparatus outputs under positive pressure to a paper micro filter bag having the capability of collecting particles in the order of one micron.

In operation of the high speed buffer, air at the skirt is provided with a positive boundary which does not appreciably scatter dust or debris particles as the buffer passes over a floor surface being polished. Dust contaminated air under the protective hood and skirt is entrained and rotates under the protective hood. The air encountering such rotation enters into the expanded hood volume encountering the deflector at a point of maximum hood volume. The communicated dust vacuum is provided with buffer entrained dust contaminated air through the dust collection aperture of the protective hood under positive pressure through the dust collection aperture in the hood. This dust contaminated air is discharged under positive pressure through to the dust collecting micro filter air bag for substantial dust free operation of the buffer.

Thus, the skirt with the angled cuts allows air to flow in an inward direction to the underside of the protective hood body. This establishes the required dust containment boundary between the surface being polished on the inside of the hood and remainder of the floor surface on the exterior of the hood.

The buffer pad assembly turning at high speed inside the protective hood and depending skirt causes this inward flow of air to flow around under the protective hood toward the casing or damn assembly.

The cupped chute or dam catches the air and entrained dust and directs it into the vacuum at the intake to the vacuum. Such redirection occurs under a positive pressure produced by the redirected air from the chute or dam.

An active vacuum is powered off the same motor shaft that drives the buffer. This causes a suction on the redirected air at the chute or dam and exhausts it into a connected vacuum bag.

A connected commercially available vacuum bag is utilized having the ability to trap particles down to a dimension of one micron. This bag effectively collects the dust and keeps it in the bag, not allowing particles larger than one micron from flowing back into the air adjacent the buffing site.

BRIEF DESCRIPTION OF THE DRAWINGS

Other objects, features and advantages of this invention will be more apparent after referring to the following specification and attached drawings in which.

DESCRIPTION OF THE PREFERRED EMBODIMENT

Figure 1:
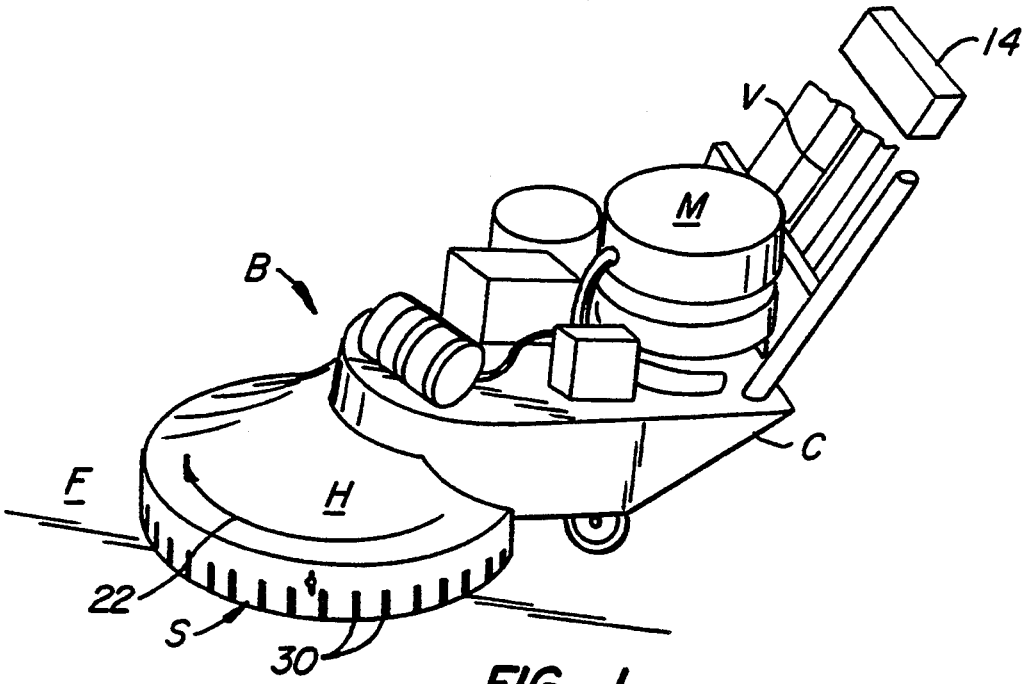
FIG. 1 is a perspective view of the high speed buffer of this invention.
Figure 3:
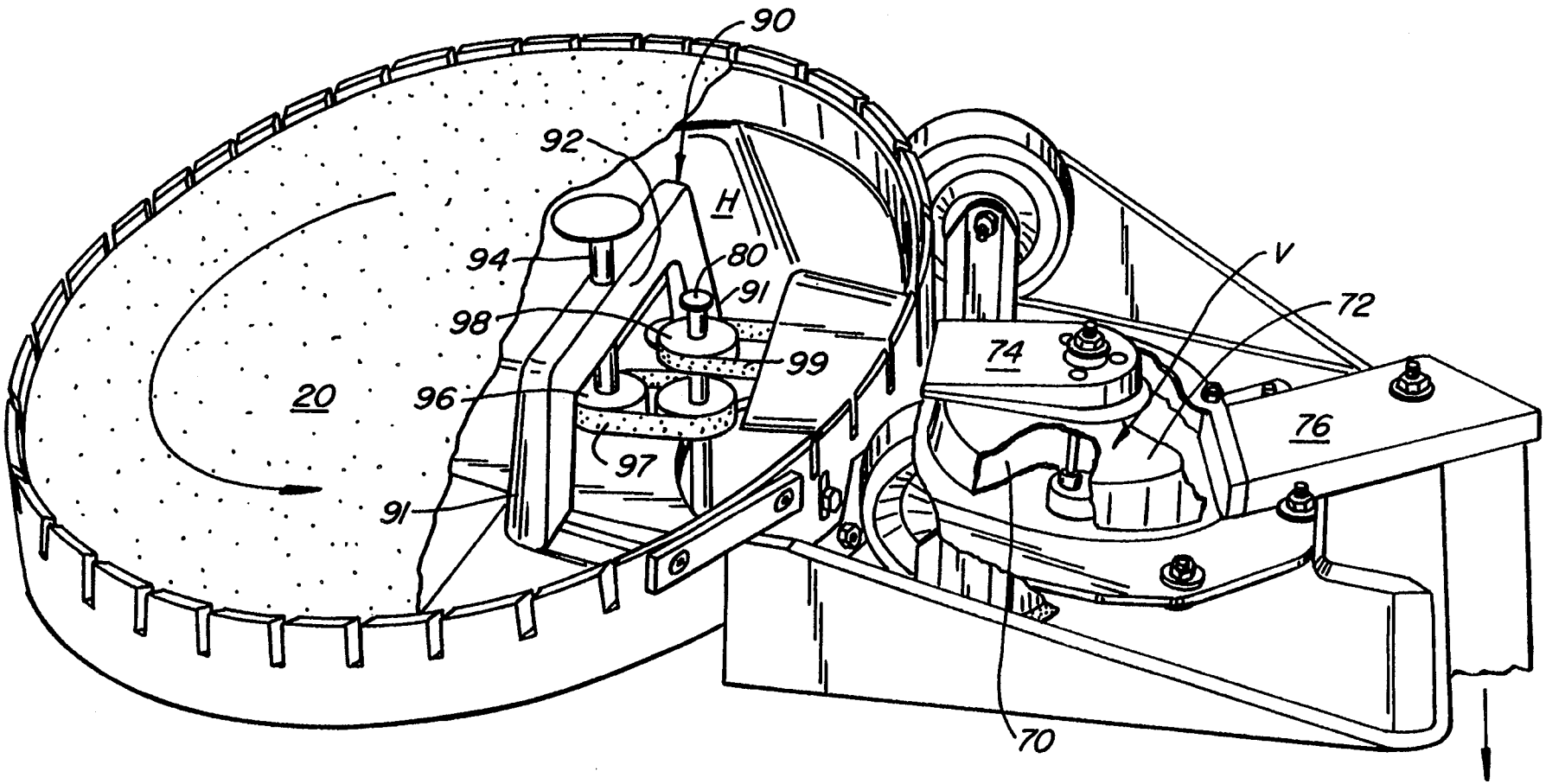
FIG. 3 is a cut away view illustrating the drive of the buffer and vacuum attachment from the spindle of the motor and illustrating the housing relative to the belt drive path.

Referring to FIG. 1, the high speed buffer B according to this invention is illustrated. It includes a chassis C mounted on wheels 16 for transport over a floor F being polished. Propane powered motor M drives a buffer 20 (not shown in FIG. 1, see FIG. 3). Buffer 20 rotates and polishes floor F under protective hood H. Simultaneously, motor M powers vacuum apparatus V which exhausts accumulated dust from buffing to paper bag filter 14.

Hood H includes a peripheral depending skirt S. Skirt S is mounted in telescoping relation to the edge of protective hood H; it is capable of moving towards and away from floor F as buffer 20 passes in polishing rotation over the floor. As will hereafter be made apparent, skirt S contains louvers 30 at the bottom floor contacting portion of the skirt S. It is the special configuration of these louvers 30 with respect to the periphery of rotating buffer 20 that enables dust confinement.

In the understanding of this invention, the interaction of the periphery of rotating buffer 20 and skirt S at louvers 30 will first be set forth with reference to FIGS. 4 and 5. Thereafter, the shape of the interior of protective hood H with respect to the underlying and rotating buffer will be emphasized with respect to FIGS. 2 and 3. Finally, the mechanism for the common drive of the buffer 20 and vacuum apparatus V from a common shaft of propane motor M will be set forth.

Figure 4:
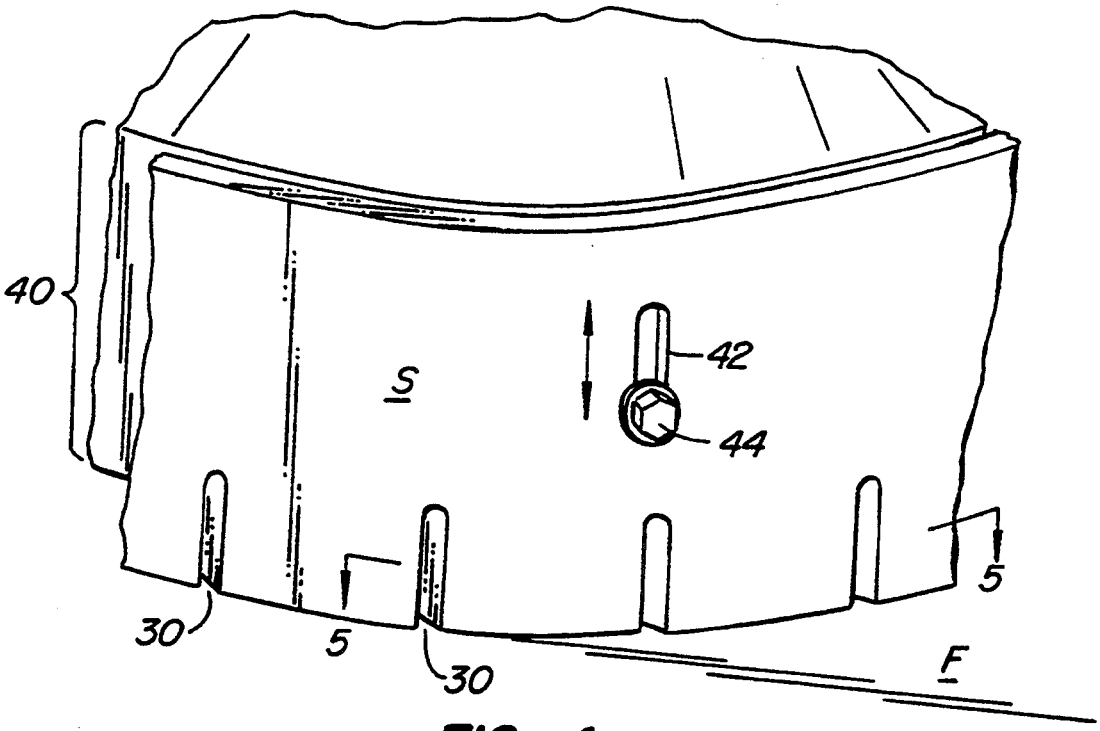
FIG. 4 is a detail of the skirt showing the telescopic mounting of the skirt.
Figure 5:
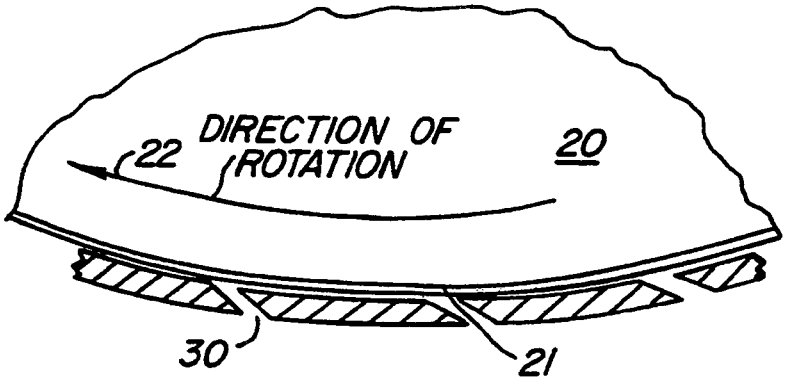
FIG. 5 is a detail of the periphery of the rotating buffer and the slanted grooves in the depending skirt; and, FIG. 6 is a perspective view of an alternate embodiment of this invention including a protective hood having a peripheral exhaust collection aperture.

Referring to FIGS. 4 and 5, the action of the depending skirt S can be understood.

At the periphery, protective hood H includes depending annulus 40. Annulus 40 typically terminates at a fixed distance above floor F.

Skirt S constitutes a flexible strip S fixed to the exterior of annulus 40. Fastening occurs at vertical slots 42 between bolt heads 44 on the outside and the threaded interior of the bolt conventionally fastened to annulus 40.

Mounting of bolt 44 is loose relative to the thickness of skirt S. Thus, skirt S is free to move upwardly and downward with respect to protective hood H. Skirt S maintains constant contact with the floor.

Louvers 30 are placed at intervals around skirt S adjacent floor F. I prefer that the louvers have intervals between them in the order of less than two inches. Typically skirt S is given a length to surround about 300° of the protective hood H. The remaining interval of protective hood H—located between the chassis handles 19—is occupied by the vacuum deflector.

Louver 30 slant relative to the direction of rotation of buffer 20. Specifically, such slanting here is illustrated at an angle of 45°—although angles of slant from 30° to 60° will suffice for the practice of this invention. It will be noted that the slant of the louvers 30 with respect to the direction of rotation 22 of buffer 20 is chosen so that air entrained by the periphery 21 of buffer 20 is drawn from the exterior of skirt S to the interior of skirt S tangent to the direction of buffer rotation.

Another observation can be made about the construction of louvers 30. Specifically, louvers 30 are slanted with respect to the radial direction. This slant is such that it is not possible to obtain a line-of-sight view radially from the center of rotation of buffer 20 through the louvers 30 to the exterior of skirt S.

Observation of the operation of this skirt S and louvers 30 with a high speed rotating buffer is instructive.

Specifically, debris present on the floor in the intended polishing path of the buffer is gently swept aside at the boundary of skirt S. This is to be contrasted with the case of either louvers normal to the skirt or a skirt without louvers; in either of these case such particles are rapidly moved away from the skirt boundary—usually at distances exceeding 6 inches by a continuous high blast of exiting air at the periphery of the buffer 20.

The width of the louver is important. Normally I prefer a width in the range of $\frac{1}{4}$ of an inch or less. Widths from $\frac{1}{2}$ to $\frac{1}{8}$ inch or less will suffice for the purposes of this invention. With narrow grooves, lesser groove pitch and a greater total number of grooves may be required.

Having set forth the operation of the skirt S and slanted louvers 30, understanding the configuration of the underside of protective hood H overlying the top of high speed rotating buffer 20 can be understood.

Figure 2:
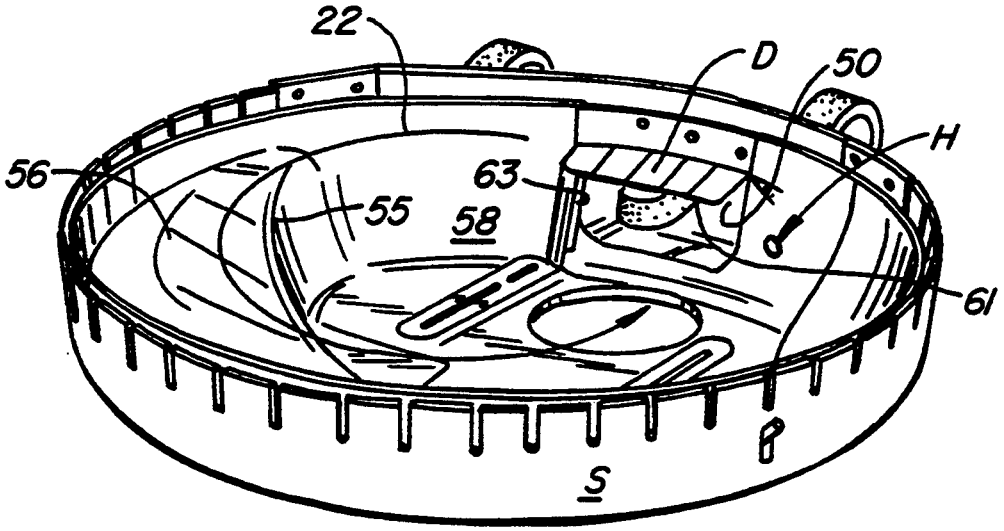
FIG. 2 is an inverted view of the buffer housing illustrating the housing shape and showing the attachment of the deflector.

Referring to FIG. 2, protective hood H is illustrated inverted. Buffer 20 is not shown. What is seen is the upper surface of protective hood H as it overlies the upwardly exposed top of high speed buffer 20.

Those familiar with rapidly rotating objects will remember that such objects entrain air adjacent their respective surfaces. Thus, the top side of high speed buffer 20 will entrain air, causing air to rapidly rotate under protective hood H in the direction of buffer rotation 22.

Observing both FIG. 1—the view from the top of the protective hood H—and FIG. 2—the view from the bottom of the protective hood H, it will be seen that as the air is entrained by the top of the rotating buffer in the direction of arrow 22. Air will move from an area of low clearance between the bottom of hood H over buffer 20 to an area of high clearance between the bottom of hood H over buffer 20 in the vicinity of vacuum exhaust 50. This directs the air flow upward as pad 20 turns clockwise with respect to the view of FIG. 1 and counterclockwise with respect to the view of FIG. 2. This lifts the air and entrained dust higher and directs it into the vacuum exhaust 50.

Hood H includes a dust exhaust aperture 50. It is to this dust exhaust aperture 50 that vacuum V is communicated. (See FIG. 1). Two features on the underside of hood H cooperate with air rotating in the direction of rotation 22 to assure the collection of fine dust particles liberated during buffing.

First, and immediately beyond dust collecting aperture 50 in the direction of rotation 22, an interior ledge 55 is provided. Ledge 55 is the dividing line between a small volume 56 overlying the top of buffer 20, and a large volume 58 overlying the top of buffer 20. The effect of these respective volumes—together with the interaction of ledge 55—is easily understood.

Specifically, a buffer 20 rotates, air overlying the top of buffer 20 also rotates. At large volume 58, against ledge 55, stalling of the entrained air occurs. Such stalling occurs conveniently in the proximity of dust collection aperture 50.

It has been found useful to scoop air directly overlying the top surface of high speed rotating buffer 20. Accordingly, a deflector D having a scoop portion 61 and a collection aperture deflection portion 63 is mounted to the underside of protective hood H. This section cooperates with deflector 63 to cause dust collection aperture 50 to receive air under positive pressure. It is noted that the dam is cupped to better direct the flow into vacuum exhaust 50.

Having set forth the construction of the underside of protective hood H, the simultaneous drive of buffer 20 and vacuum V can now be set forth. While this arrangement is shown in the embodiment of FIGS. 1 through 5, it is not required. For example, in the embodiment of FIG. 6, the drive belt occupies a different path.

Vacuum V is conventional—in this case a standard item of purchase commercially available. It includes an intake duct 74 communicating centrally to the axis of rotation of air impeller 70. Impeller 70 when undergoing high speed rotation causes air to be drawn from intake duct 74 and discharged peripherally at discharge duct 76.

Intake duct 74 is also the path through which belt 79 riding on pulley 80 from propane powered motor M drives vacuum V.

Mounting of buffer disk 20 is relatively conventional. U-shaped yoke 90 is bolted ends 91 to the underside of protective hood H. Shaft 94 is mounted at bearing 92 and driven by belt 97 on pulley 96. A similar pulley 98 mounted to motor shaft 80 effects drive of vacuum V. Thus it will be understood that simultaneous drive of buffer 20 and vacuum V simultaneously occurs.

The reader will understand that I have taken the expedient of having both the rotation of top surface of buffer 20 and the vacuum V cooperating in the removal of dust through dust collection aperture 50. The reader will understand that dust from buffing is extremely fine—going down to a particle size in the range of 1 micron. This being the case, exhaust of vacuum V occurs usually to a paper filter for screening out particles having a dimension greater than 1 micron. As a relatively high pressure is required for this necessary type of filtering, both the interaction of at least the air impelled by buffer 20 and vacuum V is required. A preferred filter is the Hysurf Micro Filter Bag sold by the Dupont Corporation of Wilmington, Del.

Figure 6:
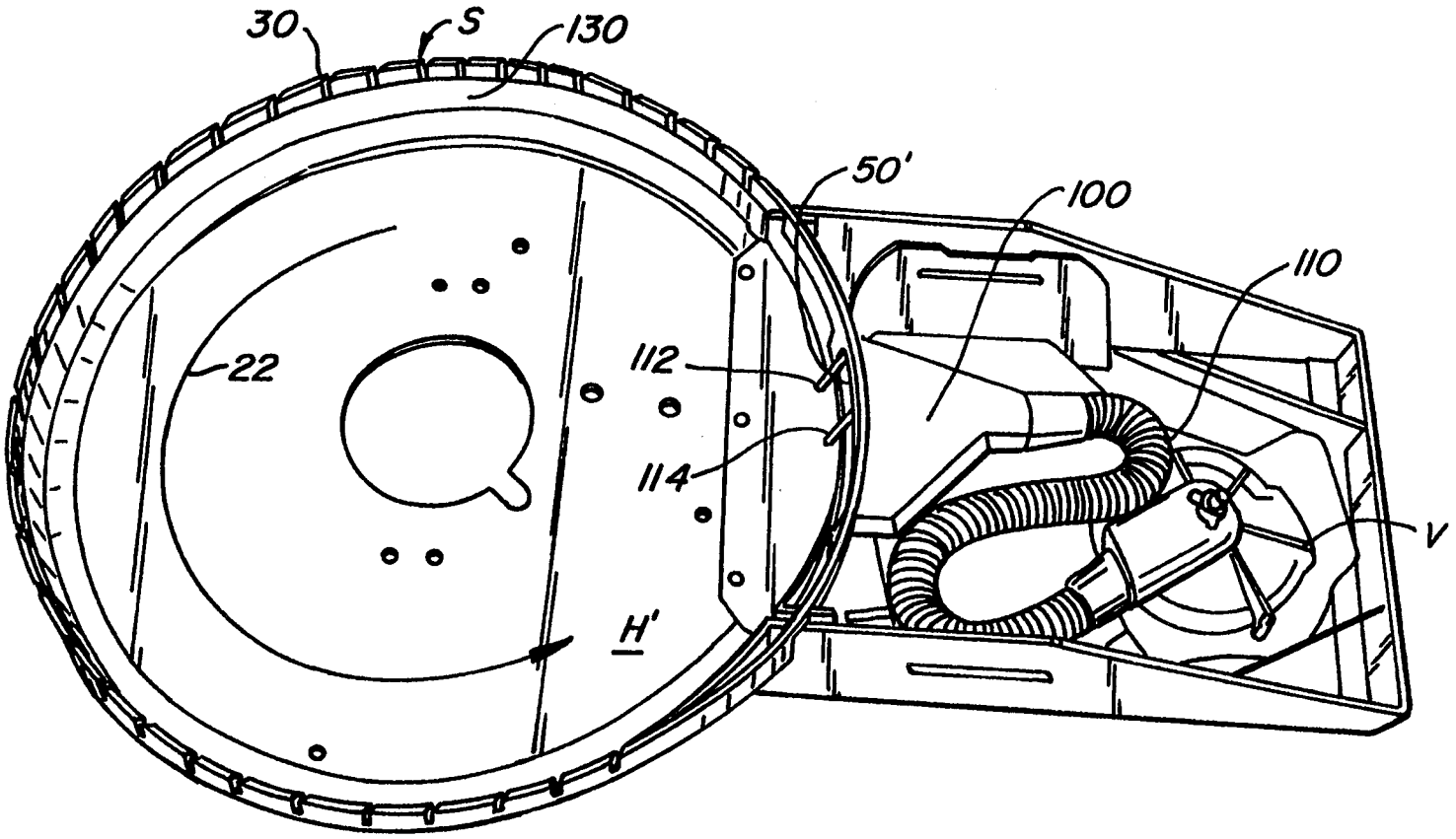

Referring to FIG. 6, an alternate hood H′ is illustrated. In this hood design, the distance between the top of buffer 20 and the underside of hood H′ remains constant.

A vacuum exhaust 50′ is located in a peripheral wall 130 of skirt S extending normally to the major upper surface of the hood H′ and the surface being polished. Buffer rotation occurs in the direction of arrow 22. This rotation causes air entrapped by the peripheral wall 130 to impact dam 100 leading through conduit 110 to vacuum V.

The construction of dam 100 can be easily understood. Dam 100 includes deflectors 112, 114 protruding into the radial interstitial interval between the periphery of rotating buffer 20 and peripheral walls 130. These deflectors 112, 114 cause buffer 20 entrained air to be introduced under positive pressure to vacuum inlet 50′. Thus, vacuum V is assisted in the required evacuation of air entrained dust from under hood H′. As before, louvers 30 are utilized in skirt S for establishing the required boundary between hood H′ and the exterior of the surface being buffed.

What is claimed is:

1. A dust evacuation system for a high speed power buffer wherein said buffer includes a chassis mounted for movement along a directed path over a surface to be polished, a motor mounted to said chassis, a high speed polishing buffer depending from said chassis driven by said motor in rotating contact with the floor along a preselected direction of rotation, and a protective hood mounted to said chassis and depending to cover said high speed rotating buffer, the dust evacuation system comprising in combination:

a peripheral skirt depended from said hood immediate the periphery of said buffer;

said skirt, at the extremity adjacent the surface to be polished having grooves, said grooves inclined with respect to the radial direction of rotation of said buffer pad, said grooves inclined to slant from outside of the skirt to the inside of the skirt in the direction of buffer disc rotation at the disc periphery, said grooves as inclined co-acting with said buffer when rotating to entrain air in the direction of buffer disc rotation from the outside of the skirt to the inside of the skirt;

a dust collector aperture adjacent said buffer defined in said hood for the outlet of dust from inside said hood to the exterior of said hood;

a deflector for deflecting air under positive pressure to a dust collector inlet, said deflector protruding into an expanded volume of said protective hood between the bottom of said hood and the top of said rotating disc;

a vacuum pump having an inlet drawing suction on the dust collector inlet deflector and an output for discharging air under positive pressure;

means for collecting said dust communicated to said vacuum pump at said output; and, said peripheral skirt depended from said hood immediate the periphery of said buffer is telescopically suspended from said hood for towards and away movement with respect to said floor from said protective hood.

2. A dust evacuation system for a high speed power buffer according to claim 1 and wherein:

said means for collecting said dust communicated to said vacuum pump at said output includes a dust collection bag.

3. A dust evacuation system for a high speed power buffer according to claim 1 and wherein:

said protective hood defining overlying said buffer a concavity expands in the direction of buffer rotation from a narrow dimension immediately beyond a hood dust collection aperture to a large volume at the dust collection aperture.

4. A dust evacuation system for a high speed power buffer according to claim 1 and wherein:

the slant of said grooves is such that it is not possible to obtain a line-of-sight view radially from the center of rotation of said buffer through said grooves through the exterior of skirt.

5. A dust evacuation system for a high speed power buffer according to claim 1 and wherein:

said dust collection aperture adjacent said buffer defined in said hood to the exterior of said hood extends through a downward depending radial wall of said hood.

6. A dust boundary for a high speed power buffer wherein said buffer includes a chassis for movement along a directed path over a surface to be polished, a motor mounted to said chassis, a high speed polishing buffer pad depending from said chassis driven by said motor, a protective hood mounted to said chassis and depending to cover said high speed rotating buffer, and a dust evacuation system communicated through said hood for evacuating dust contaminated air from under said hood overlying said rotating buffer, the improvement comprising:

a peripheral skirt depended from said hood immediate the periphery of said buffer, said skirt mounted for towards and away movement from a surface being polished by said buffer;

said skirt, at the extremity adjacent the surface to be polished having grooves inclined with respect to the radial direction of said buffer pad, said grooves having angularly inclined grooves slanting from outside the skirt with respect to the radial direction to the inside of the skirt in the direction of buffer disc rotation at the disc periphery, said grooves as inclined co-acting with said buffer when rotating to entrain air in the direction of buffer disc rotation from the outside of the skirt to the inside of the skirt to establish a dust boundary is established at said skirt between said buffer under said protective hood and the exterior of said skirt; and, said peripheral skirt depended from said hood immediate the periphery of said buffer is telescopically suspended from said hood for towards and away movement with respect to said floor from said protective hood.

7. A dust evacuation system for a high speed power buffer according to claim 6 and wherein:

said protective hood overlying said buffer expands in the direction of buffer rotation from a narrow dimension immediately beyond a hood dust collection aperture to a large volume at the dust collection aperture.

8. A dust evacuation system for a high speed power buffer according to claim 6 and wherein:

the slant of said grooves is such that it is not possible to obtain a line-of-sight view radially from the center of rotation of said buffer through said grooves through the exterior of skirt.

9. A dust evacuation system for a high speed power buffer according to claim 6 and wherein:

said dust collection aperture adjacent said buffer defined in said hood to the exterior of said hood extends through a downward depending radial wall of said hood.

* * * * *